US007367734B2

(12) United States Patent
Saeki

(10) Patent No.: US 7,367,734 B2
(45) Date of Patent: May 6, 2008

(54) PRINTER

(75) Inventor: Yasushi Saeki, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 122 days.

(21) Appl. No.: 10/922,599

(22) Filed: Aug. 20, 2004

(65) Prior Publication Data

US 2005/0072329 A1 Apr. 7, 2005

(30) Foreign Application Priority Data

Aug. 22, 2003 (JP) ..... 2003-298258

(51) Int. Cl.
*B41J 2/01* (2006.01)

(52) U.S. Cl. ..... 400/636; 400/624; 400/625; 400/637; 271/3.05

(58) Field of Classification Search ..... 400/624, 400/625, 636, 637, 637.1, 637.5, 637.6, 638, 400/639; 271/3.05, 14, 226
See application file for complete search history.

(56) References Cited

U.S. PATENT DOCUMENTS 5,230,503 A * 7/1993 Saito et al. ..... 271/121
5,294,106 A * 3/1994 Takagi et al. ..... 271/164
5,594,486 A * 1/1997 Kiyohara ..... 347/104
5,673,074 A * 9/1997 Miyauchi et al. ..... 347/104
5,732,321 A * 3/1998 Ishizuka et al. ..... 399/391
5,868,508 A * 2/1999 Suzuki ..... 400/692
6,132,119 A * 10/2000 Nakajima et al. ..... 400/613
6,474,883 B1 * 11/2002 Kawakami et al. ..... 400/613
6,719,286 B1 * 4/2004 Ohyama et al. ..... 271/119
6,928,251 B2 * 8/2005 Yoshihara et al. ..... 399/107
2002/0113855 A1 * 8/2002 Baum ..... 347/104

FOREIGN PATENT DOCUMENTS

JP 2002-53241 2/2002
JP 2002-068517 3/2002
JP 2002-154701 5/2002
JP 2002-220147 8/2002

OTHER PUBLICATIONS

Patent Abstracts of Japan, Publication No. 2002-053241 dated Feb. 19, 2002, 1 pg.

(Continued)

*Primary Examiner*—Daniel J. Colilla
*Assistant Examiner*—Kevin D. Williams
(74) *Attorney, Agent, or Firm*—Osha Liang LLP

(57) ABSTRACT

A printer less susceptible to paper jams, allowing reduction in number of components and having superior printing precision is provided. The printer includes a chassis, a printing portion mounted on the chassis for printing on a sheet of recording paper, a press roller rotatably mounted on the chassis, kept at an approximately constant distance from the printing portion for pressing the sheet of recording paper, a feed roller rotatably mounted on chassis, movable in directions toward and away from the press roller and holding the sheet of recording paper in close contact with the press roller, and a spring urging the feed roller to the press roller. The chassis has a guide portion extended to guide a sheet of recording paper between the press roller and the feed roller.

11 Claims, 6 Drawing Sheets

OTHER PUBLICATIONS

Notice of Ground of Rejection, mailed Nov. 22, 2005, with English translation (4 pages).
Patent Abstracts of Japan, Publication No. 2002-220147, dated Aug. 6, 2002 (2 pages).
Patent Abstracts of Japan, Publication No. 2002-154701, dated May 28, 2002 (2 pages).
Patent Abstracts of Japan, Publication No. 2002-068517, dated Mar. 8, 2002 (2 pages).

* cited by examiner

PRINTER

BACKGROUND OF THE INVENTION

1. Field of the Invention

The present invention relates to a printer and, more specifically, to a printer having a paper feed mechanism.

2. Description of the Background Art

A conventional printer is disclosed, for example, in Japanese Patent Laying-Open No. 2002-053241.

FIG. 6 is a schematic side view of a conventional printer. FIG. 7 is a perspective view of a chassis shown in FIG. 6. Referring to FIGS. 6 and 7, a conventional printer 1 has a chassis 10. On chassis 10, a press roller 20 and a feed roller 30 are mounted. Feed roller 30 is rotatable in a direction indicated by an arrow 30*b*, and as feed roller 30 rotates, a sheet of recording paper 100 pinched between feed roller 30 and press roller 20 is fed.

On chassis 10, a motor bracket 64 is mounted. On chassis 10, a shaft 41 is rotatably held close to motor bracket 64, and on shaft 41, a gear 43 is mounted. Gear 43 receives the rotating force of the motor and rotates.

A feed gear 31 is mounted to be engaged with gear 43. Feed gear 31 is connected to feed roller 30, and as feed gear 31 rotates, feed roller 30 also rotates.

On chassis 10, a press roller holder 21 is attached rotatable in the direction indicated by an arrow 21*a*, and at a tip end portion of press roller holder 21, press roller 20 is held. Press roller holder 21 urges press roller 20 toward feed roller 30.

On chassis 10, a carrier assay 51 is mounted, and carrier assay 51 includes a printing portion 50. Printing portion 50 sprays ink to a sheet of recording paper 100, so as to print characters and images on the sheet of recording paper 100.

As shown in FIG. 7, on an end portion of feed roller 30, feed gear 31 is positioned, and feed roller 30 is held by a bearing 38 on chassis 10.

In such printer 1, when gear 43 receiving the rotation of the motor rotates, feed gear 31 also rotates. Accordingly, feed roller 30 positioned coaxially with feed gear 31 rotates in the direction indicated by an arrow 30*b*. As the sheet of recording paper 100 is pinched between feed roller 30 and press roller 20, the sheet of recording paper 100 also moves, and thus, the paper is fed.

Such a conventional printer, however, requires a press roller holder 21 for holding press roller 20, and therefore, the number of components is disadvantageously large.

Further, press roller 20 attached to press roller holder 21 rotates in the direction indicated by an arrow 21*a*. Therefore, the distance between the sheet of recording paper 100 and printing portion 50 may vary, possibly degrading precision of printing.

SUMMARY OF THE INVENTION

The present invention was made to solve the above described problems, and its object is to provide a printer having smaller number of components and attaining higher precision of printing.

According to one aspect, the present invention provides a printer including: a chassis; a printing portion mounted on the chassis for printing on a sheet of recording paper; a press roller rotatably mounted on the chassis, kept at an approximately constant distance from the printing portion and pressing the sheet of recording paper; a feed roller rotatably mounted on the chassis, movable in directions toward and away from the press roller, and holding the sheet of recording paper in close contact with the press roller; and a spring urging the feed roller to the press roller. The chassis has a guide portion extended to guide the sheet of recording paper between the press roller and the feed roller.

In the printer structured as described above, it is unnecessary to rotate the press roller in a prescribed direction. Therefore, the conventional press roller holder for holding the press roller becomes unnecessary. As a result, the number of components can be reduced.

Further, the distance between the press roller and the printing portion is almost constant, and the distance between the sheet of recording paper held by the press roller and the feed roller and the printing portion is also almost constant. As a result, highly precise printing on the sheet of recording paper becomes possible.

Further, even when a large number of sheets of paper are fed, the feed roller moves away from the press roller, and as a result, paper jam can be avoided. Further, printing on a thick sheet of paper is also possible.

According to another aspect, the present invention provides a printer, including: a chassis; a printing portion mounted on the chassis for printing on a sheet of recording paper; a press roller rotatably mounted on the chassis, kept at an approximately constant distance from the printing portion and pressing the sheet of recording paper; and a feed roller rotatably mounted on the chassis, movable in directions toward and away from the press roller, and holding the sheet of recording paper in close contact with the press roller.

In the printer structured as described above, it is unnecessary to rotate the press roller in a prescribed direction. Therefore, the conventional press roller holder for holding the press roller becomes unnecessary. As a result, the number of components can be reduced.

Further, the distance between the press roller and the printing portion is almost constant, and the distance between the sheet of recording paper held by the press roller and the feed roller and the printing portion is also almost constant. As a result, highly precise printing on the sheet of recording paper becomes possible.

Further, even when a large number of sheets of paper are fed, the feed roller moves away from the press roller, and as a result, paper jam can be avoided. Further, printing on a thick sheet of paper is also possible.

Preferably, the printer further includes urging means for urging the feed roller toward the press roller.

In that case, the sheet of recording paper can surely be pinched between the feed roller and the press roller, and highly precise printing becomes possible.

According to the present invention, a printer can be provided, which allows reduction in number of components, which is less prone to paper jam and capable of highly precise printing.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
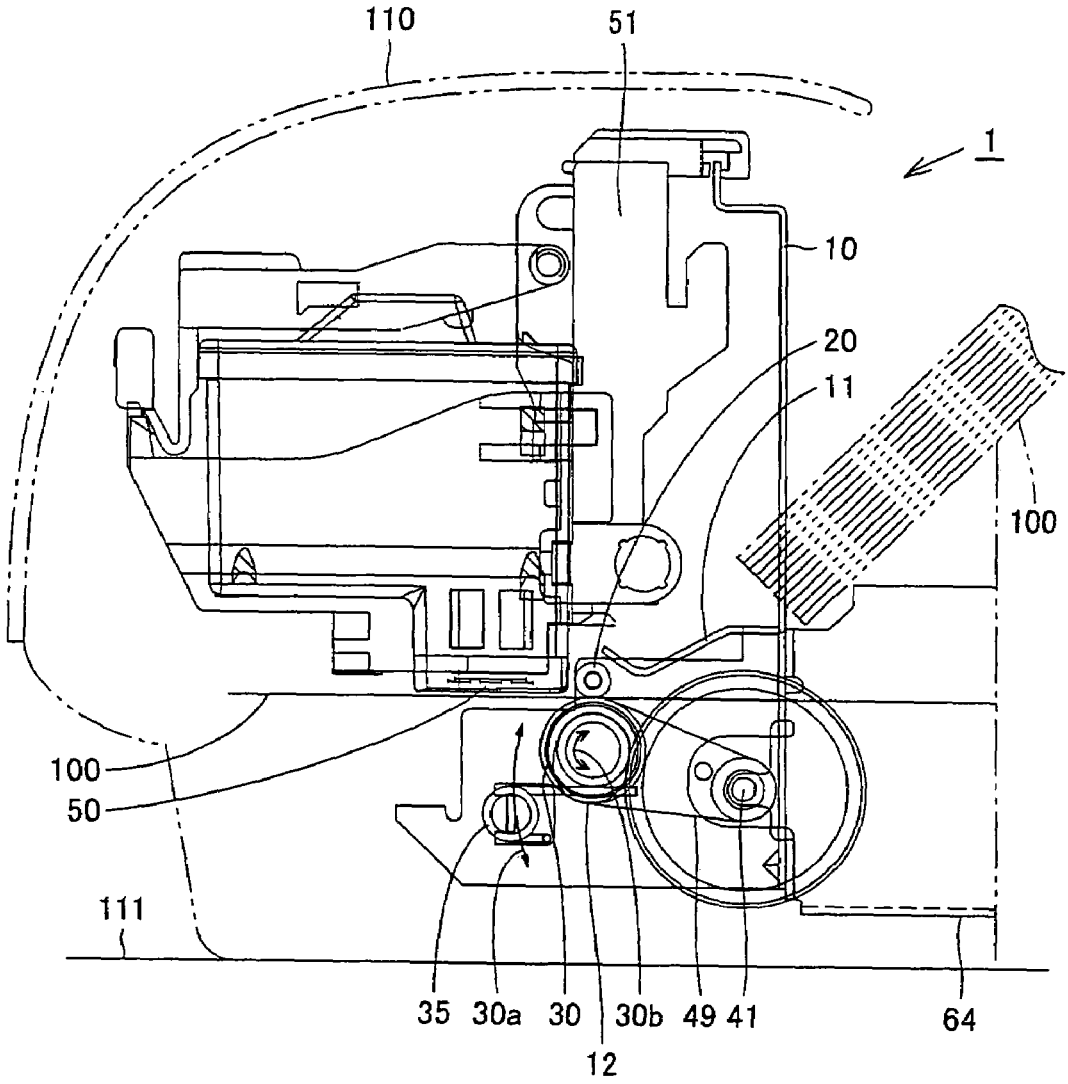
FIG. 1 is a schematic side view of the printer in accordance with the present invention.

Embodiments of the present invention will be described in the following with reference to the figures. The same or corresponding portions will be denoted by the same reference characters, and description thereof will not be repeated.

Figure 2:
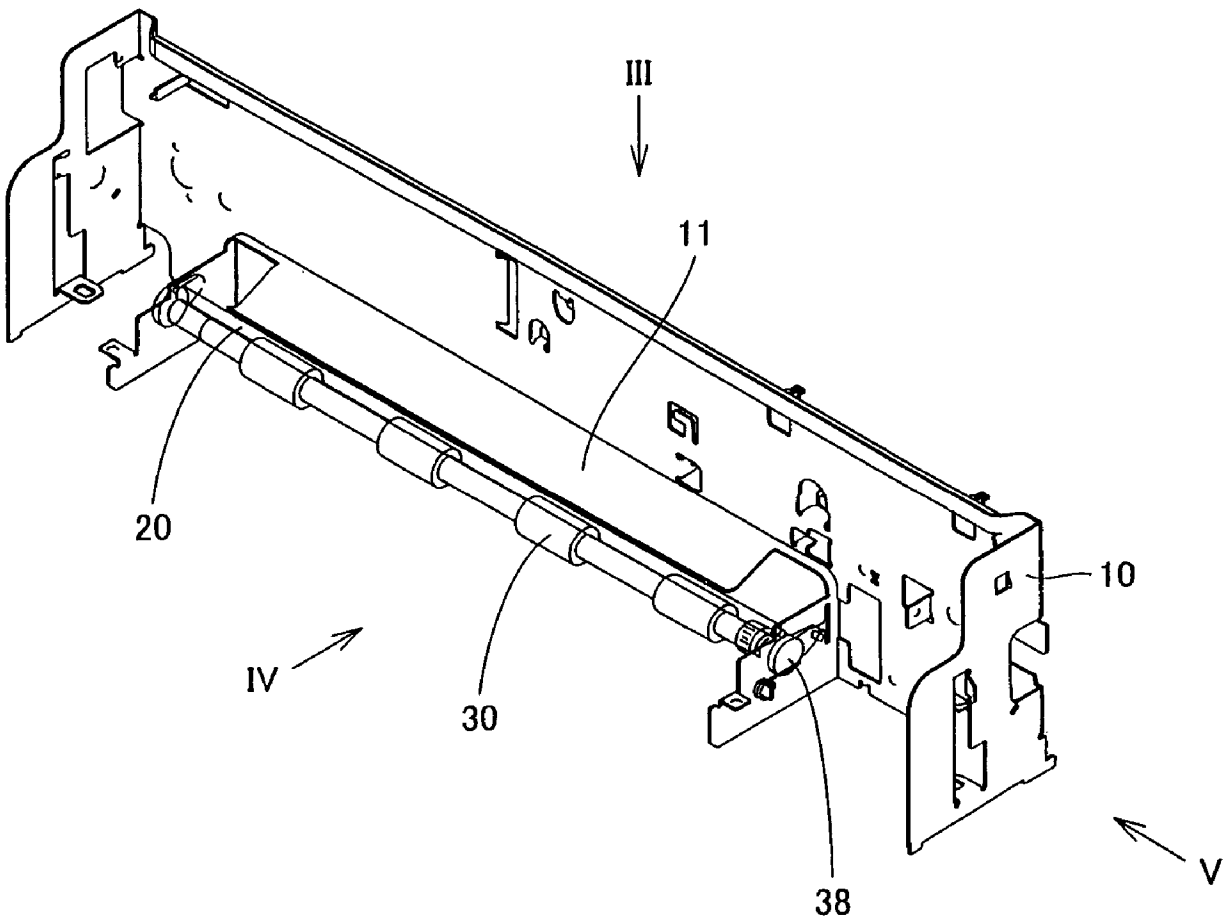
FIG. 2 is a perspective view of the chassis shown in FIG. 1.

Referring to FIGS. 1 and 2, printer 1 in accordance with the present invention includes a chassis 10; a printing portion 50 mounted on chassis 10 for printing on a sheet of recording paper 100; a press roller 20 rotatably mounted on chassis 10, kept at an approximately constant distance from printing portion 50 and pressing the sheet of recording paper 100; a feed roller 30 rotatably mounted on chassis 10, movable in directions toward and away from press roller 20, and holding the sheet of recording paper 100 in close contact with press roller 20; and a spring 35 as urging means for urging feed roller 30 to press roller 20. Chassis 10 has a guide portion 11 extended to guide the sheet of recording paper 100 between press roller 20 and feed roller 30.

Chassis 10 is contained in a housing 110 of printer 1. From the lower side of chassis 10 (close to the surface 111 on which the printer is installed), feed roller 30 and press roller 20 are provided in this order. On chassis 10, a motor bracket 64 is provided, which motor bracket 64 holds a motor, not shown.

At a lower portion of the chassis, that is, on the side closer to the installment surface 111, a belt 49 for connecting a shaft 41 with feed roller 30 is provided. When the motor (not shown) rotates shaft 41, the rotation of shaft 41 is transmitted through belt 49 to feed roller 30. Thus, feed roller 30 rotates and feeds the sheet of recording paper 100.

Printer 1 shown in FIG. 1 is different from conventional printer 1 in that feed roller 30 is movable (rotatable) in a direction indicated by an arrow 30*a*. Feed roller 30 can move along an elongate hole 12 provided in chassis 10, and is urged toward press roller 20 by spring 35.

Further, a part of chassis 10 forms a guide portion 11 guiding a sheet of recording paper 100. Guide portion 11 guides the sheet of recording paper 100 such that the sheet of recording paper 100 is fed between feed roller 30 and press roller 20.

Referring to FIG. 2, an end of cylindrical feed roller 30 is held by means of a bearing 38 on chassis 10. As bearing 38 is inserted, feed roller 30 can be held rotatably on chassis 10.

Figure 3:
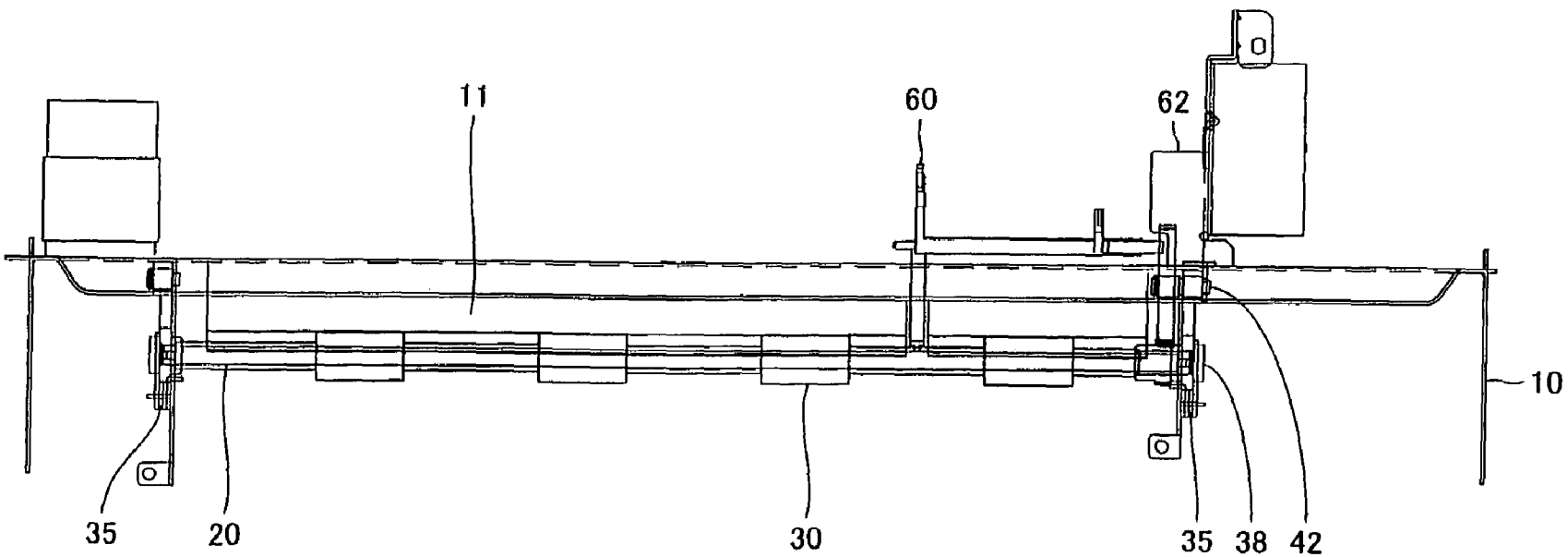
FIG. 3 is a plan view of the chassis viewed from the direction of the arrow III of FIG. 2.
Figure 4:
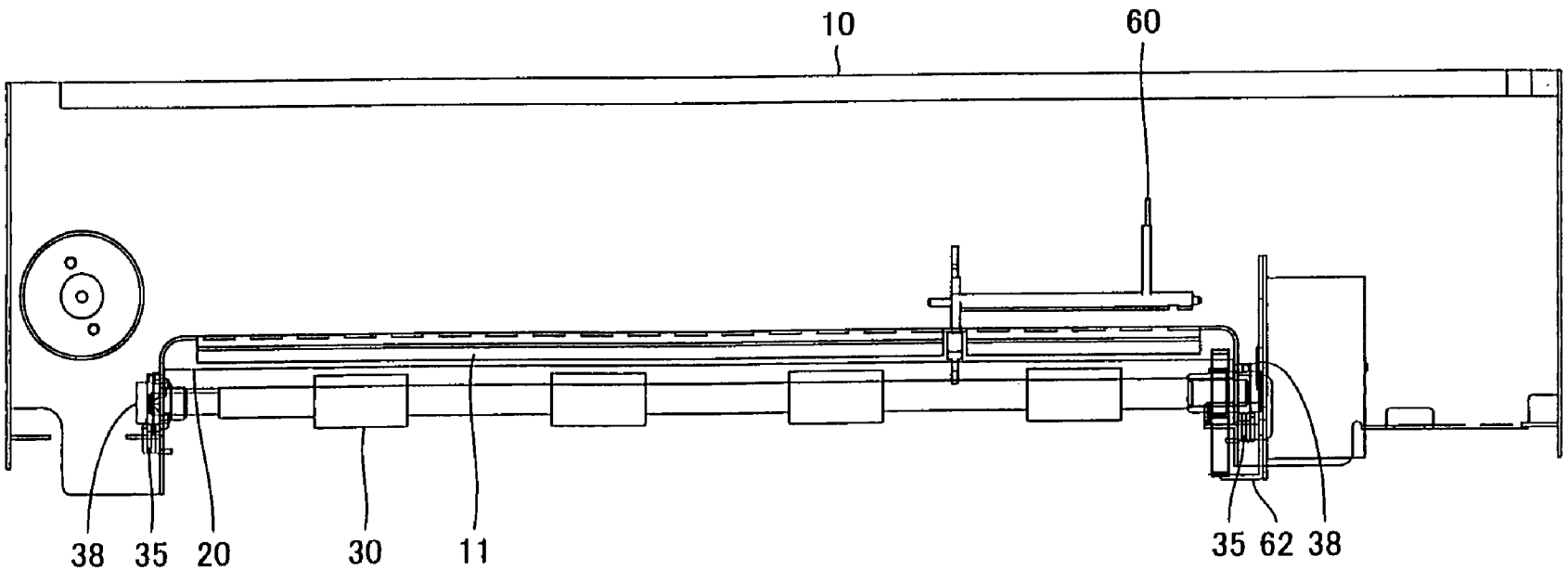
FIG. 4 is a front view of the chassis viewed from the direction of the arrow IV of FIG. 2.
Figure 5:
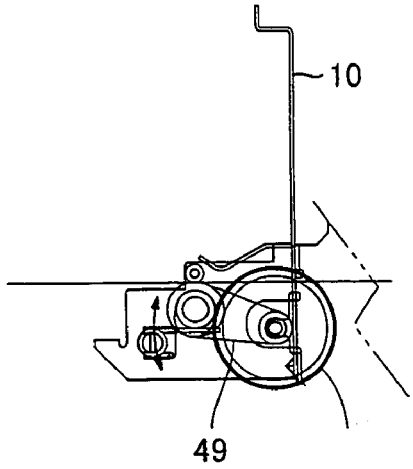
FIG. 5 is a side view of the chassis viewed from the direction of the arrow V of FIG. 2.
Figure 6:
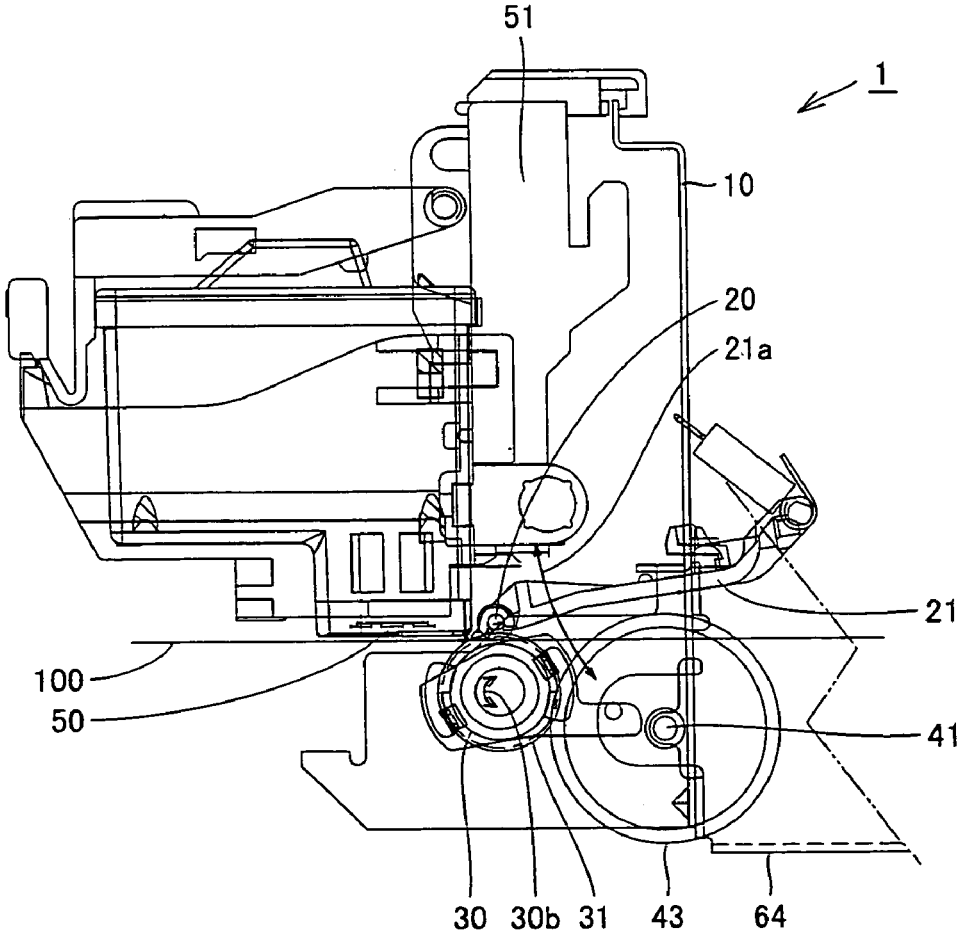
FIG. 6 PRIOR ART
FIG. 6 is a schematic side view of a conventional printer.
Figure 7:
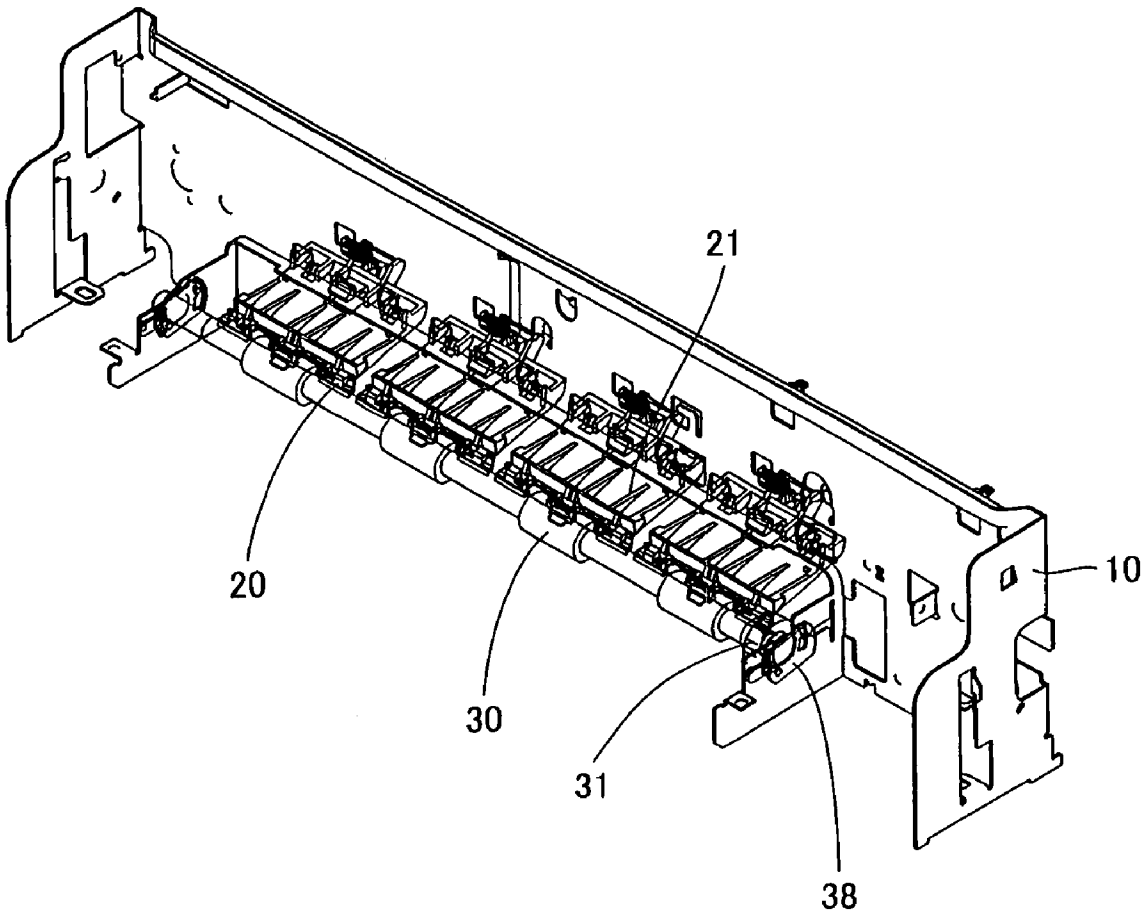
FIG. 7 PRIOR ART
FIG. 7 is a perspective view of the chassis shown in FIG. 6.

Referring to FIGS. 3 to 5, chassis 10 extends in a longitudinal direction, and feed roller 30 and press roller 20 are arranged extending in the same direction as chassis 10. Feed roller 30 and press roller 20 are arranged approximately parallel to each other. Bearings 38 are provided at opposite ends of feed roller 30, and by means of bearings 38, feed roller 30 is rotatably mounted on chassis 10.

Spring 35 as urging means attached to an end portion of chassis 10 is engaged with a cutout portion of chassis 10. Spring 35 is formed of a resilient body (torsion spring) and raises feed roller 30 from below.

A paper sensor 60 for detecting whether there is a sheet of recording paper or not between feed roller 30 and press roller 20 is provided on chassis 10. When paper sensor 60 detects a sheet of paper, printing starts.

In the printer in accordance with the present invention structured as described above, press roller is fixed by a one-piece shaft and rotates. There is a margin below feed roller 30, and even when a large amount of paper is fed, feed roller 30 can go off toward the installment surface 111. Thus, paper jam between feed roller 30 and carrier assay 51 can be prevented.

Further, as feed roller 30 is movable, printing on a thick sheet of paper becomes possible. Further, as the distance between printing portion 50 and press roller 20 is approximately constant, height of a printing surface is kept constant. As a result, quality of printed characters and the like is improved.

The sheet of recording paper 100, which has been conventionally guided by press roller holder 21, is guided by guide portion 11 as a part of chassis 10, and therefore, provision of press roller holder 21 becomes unnecessary. As a result, the number of parts of various components can be reduced, and hence the cost can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer, comprising:

a chassis;

a printing portion mounted on said chassis for printing on a sheet of recording paper;

a press roller rotatably mounted on said chassis, kept at an approximately constant distance from said printing portion, for pressing the sheet of recording paper;

a feed roller rotatably mounted on said chassis, movable in directions toward and away from said press roller, for holding the sheet of paper in close contact with said press roller; and a torsion spring in contact with said feed roller, wherein the torsion spring is attached to an end portion of said chassis and engaged with a cutout portion of said chassis, for urging said feed roller to said press roller by pressing against said feed roller;

wherein said chassis has a guide portion guiding the sheet of recording paper between said press roller and said feed roller.

2. A printer, comprising:

a chassis;

a printing portion mounted on said chassis for printing on a sheet of recording paper;

a press roller rotatably mounted on said chassis, kept at an approximately constant distance from said printing portion, for pressing the sheet of recording paper;

a feed roller rotatably mounted on said chassis, movable in directions toward and away from said press roller, for holding the sheet of paper in close contact with said press roller; and a spring in contact with said feed roller and urging said feed roller to said press roller, wherein the spring is attached to an end portion of said chassis and engaged with a cutout portion of said chassis;

wherein said chassis has a guide portion guiding the sheet of recording paper between said press roller and said feed roller.

3. The printer according to claim 2, wherein the spring exerts a force in a first direction, wherein the roller is urged in a second direction by the spring, and wherein the first direction and the second direction are substantially the same.

4. The printer according to claim 2, wherein the spring is a torsion spring.

5. The printer according to claim 1, wherein the torsion spring exerts a force in a first direction, wherein the roller is urged in a second direction by the torsion spring, and wherein the first direction and the second direction are substantially the same.

6. The printer according to claim 1, wherein the chassis comprises an elongate hole, along which the feed roller moves toward and away from the press roller.

7. The printer according to claim 2, wherein the chassis comprises an elongate hole, along which the feed roller moves toward and away from the press roller.

8. The printer according to claim 1, wherein a motor bracket holding a motor is attached to the chassis.

9. The printer according to claim 2, wherein a motor bracket holding a motor is attached to the chassis.

10. The printer according to claim 8, further comprising a belt attached to a shaft and further attached to the feed roller, wherein the motor rotates the shaft and the rotation of the shaft transmits through the belt to rotate the feed roller.

11. The printer according to claim 9, further comprising a belt attached to a shaft and the feed roller, wherein the motor rotates the shaft and the rotation of the shaft transmits through the belt to rotate the feed roller.

* * * * *